US005961377A

United States Patent [19]

Jeong

[11] Patent Number: 5,961,377

[45] Date of Patent: Oct. 5, 1999

[54] CHEMICAL MECHANICAL POLISHING SYSTEMS INCLUDING BRUSHES AND RELATED METHODS

[75] Inventor: In-kwon Jeong, Kyungki-do, Rep. of Korea

[73] Assignee: Samsung Electronics Co., Ltd., Rep. of Korea

[21] Appl. No.: 08/921,651

[22] Filed: Aug. 26, 1997

[30] Foreign Application Priority Data

Jan. 17, 1997 [KR] Rep. of Korea ..... 97-1294

[51] Int. Cl.[6] ..... B24B 53/00

[52] U.S. Cl. ..... 451/56; 451/444

[58] Field of Search ..... 451/56, 444, 443, 451/66, 72

[56] References Cited

U.S. PATENT DOCUMENTS 5,361,545 11/1994 Nakamura ..... 451/290
5,384,986 1/1995 Hirose et al. ..... 451/444
5,536,202 7/1996 Appel et al. ..... 451/285

FOREIGN PATENT DOCUMENTS 4035871 2/1992 Japan ..... 451/526
4310364 11/1992 Japan ..... 451/143
5208361 8/1993 Japan ..... 451/270

*Primary Examiner*—Robert A. Rose
*Attorney, Agent, or Firm*—Myers Bigel Sibley & Sajovec

[57] ABSTRACT

A chemical-mechanical polishing system includes a polishing pad having a polishing surface for polishing the semiconductor substrate, and a polishing pad brush including a plurality of bristles attached to a support for cleaning the polishing surface of the polishing pad. In addition, a polishing pad brush arm is operatively coupled to the brush support for transferring the polishing pad brush to and from the polishing pad. Related methods are also discussed.

19 Claims, 5 Drawing Sheets

CHEMICAL MECHANICAL POLISHING SYSTEMS INCLUDING BRUSHES AND RELATED METHODS

FIELD OF THE INVENTION

The present invention relates to the field of microelectronics and more particularly to chemical-mechanical polishing systems and methods for microelectronic substrates.

BACKGROUND OF THE INVENTION

As the critical dimensions of integrated circuit patterns decrease with increasing integration densities, the resolution and depth of focus achieved during photolithography steps becomes more critical. Accordingly, highly planar semiconductor wafers are required. Planarization techniques have thus been developed to provide highly planar surfaces for semiconductor wafers. In particular, chemical-mechanical polishing systems and methods have been developed which provide simultaneous and efficient planarization for multiple wafers.

FIGS. 1 and 2 illustrate a conventional chemical-mechanical polishing (CMP) system. In particular, FIG. 1 is a plan view illustrating a conventional chemical-mechanical polishing system. FIG. 2A is a cross-sectional view taken along sections lines 2*a*—2*a* of FIG. 1, and FIG. 2B is a cross-sectional view taken along section lines 2*b*—2*b* of FIG. 1. As shown in FIG. 1, a polishing portion A is used to polish the surface of semiconductor substrates, and a cleaning portion B is used to clean the surfaces of the semiconductor substrates after polishing.

The polishing portion A of the system includes a first platen 10*a* having a flat end portion, a first platen rotating shaft 11*a* for rotating the first platen 10*a*, and a polishing pad 20*a* fixed on the end portion of the first platen 10*a*. The polishing portion also includes a conditioner 50 for cutting back a surface of the polishing pad 20 to expose a new surface thereof, a conditioning head 60 having an end portion fixed to the conditioner 50, and a conditioning head arm 61 for transferring the conditioning head 60. In addition, the clamp 40 has an end portion for fixing the semiconductor substrate 30 thereto, and a clamp arm 41 for transferring the clamp 40. Furthermore, the polishing pad 20*a* has fine grooves on its surface so that a polishing slurry can be provided to the center portions of the semiconductor substrate 30 even though maintained in tight contact with the polishing pad 20*a*.

The cleaning portion B includes a second platen 10*b* having a first end portion, a second platen rotating shift 11*b* for rotating the second platen 10*b*, and an auxiliary pad 20*b* fixed to the end portion of the second platen 10*b*. As shown, the clamp 40 to which the semiconductor substrate 30 is attached can be transferred from the polishing portion A to the cleaning portion B using the clamp arm 41.

The operation of the chemical-mechanical polishing system discussed above will now be explained with reference to FIGS. 1 and 2A-2B. The surface of the semiconductor substrate 30 is first polished by rotating the semiconductor substrate 30 in tight contact with the polishing pad 20*a* while a slurry is being deposited on the polishing pad 20*a*. The semiconductor substrate 30 is then moved away from the polishing pad 20*a* using the clamp 40 and the clamp arm 41. The surface of the polishing pad 20*a* is then cut back to expose a new surface thereof by rotating the conditioner 50 in tight contact with the polishing pad 20*a*. This operation is referred to as pad conditioning. The pad conditioning operation is used to reduce abrasion of the surface of the polishing pad 20*a* thereby maintaining the speed at which the semiconductor substrates 30 can be polished.

Stated in other words, the purpose for the pad conditioning operation is to expose a new polishing pad surface by cutting back the abraded surface of the polishing pad 20*a*. It may be difficult, however, to completely remove polishing particle lumps which may be formed by the agglutination of particles during the polishing step. Moreover, polishing particles from the slurry may also be difficult to remove. In particular, it may be very difficult to remove polished particle lumps and slurry particles jammed into grooves formed on the surface of the polishing pad 20*a*.

Accordingly, particle lumps remaining on the polishing pad 20*a* may produce scratches on the surfaces of semiconductor substrates polished thereon. In particular, polishing particle lumps may roughen the surface of semiconductor substrates 30 polished thereon thereby decreasing the reliability of the chemical-mechanical polishing operation. This result may occur because portions of the semiconductor substrate 30 exposed to the polished particle lumps may be more rapidly polished than portions not exposed to the lumps.

The polished semiconductor substrate 30 is then transferred from the polishing portion A to the cleaning portion B. The polish surface of the semiconductor substrate 30 is then cleaned by rotating the semiconductor substrate 30 in tight contact with the auxiliary pad 20*b* while depositing a cleaning solution onto the surface of the auxiliary pad 20*b*. Particles and polishing particle lumps, however, may stick to the semiconductor substrate 30 and may thus be transferred to the auxiliary pad 20*b*.

In addition to the cleaning operation discussed above, an auxiliary polishing operation can also be performed on the cleaning portion B of the chemical-mechanical polishing system. The auxiliary polishing operation can be used to remove scratches from the surface of the semiconductor substrate 30 formed during the polishing operation discussed above with reference to FIG. 2A. The auxiliary polishing operation is performed by depositing a slurry including polishing particles instead of the cleaning solution onto the auxiliary pad 20*b*. The auxiliary polishing operation is sometimes referred to as slurry buffing or touch up. Like the polishing operation, the auxiliary polishing operation may generate scratches on the surface of the semiconductor substrate 30 and roughen the surface of the semiconductor substrate 30.

Notwithstanding the methods and systems discussed above, there continues to exist a need in the art for improved chemical-mechanical polishing systems and methods.

SUMMARY OF THE INVENTION

It is therefore an object of the present invention to provide improved systems and methods for polishing semiconductor substrates.

This and other objects are provided according to the present invention by a chemical-mechanical polishing system including a polishing pad having a polishing surface for polishing the semiconductor substrate, and a polishing pad brush including a plurality of bristles attached to a support for cleaning the polishing surface of the polishing pad. In addition, a polishing pad brush arm is operatively coupled to the brush support for transferring the polishing pad brush to and from the polishing pad. Accordingly, particles generated during the polishing of the semiconductor substrate can be removed by the polishing pad brush. The chemical-mechanical polishing system can also include a conditioner for conditioning the polishing surface of the polishing pad, and a conditioner arm operatively coupled to the conditioner for transferring the conditioner to and from the polishing pad.

Preferably, each of the bristles comprises a synthetic resin, and each of the bristles has a diameter in the range of 10 $\mu$m to 2,000 $\mu$m.

Moreover, each of the bristles can have a diameter that decreases from a first end adjacent the support to a second end opposite the support. The reduced diameter increases the efficiency at which particles can be removed from grooves in the polishing pad.

Alternately, a chemical-mechanical polishing system can include a polishing station for polishing the semiconductor substrate and a cleaning station for cleaning the polished semiconductor substrate. The polishing station can include a polishing pad having a polishing surface for polishing the semiconductor substrate, a conditioner for conditioning the polishing surface of a polishing pad, and a conditioner arm operatively coupled to the conditioner for transferring the conditioner to the polishing pad. The cleaning station can include an auxiliary pad having a cleaning surface for cleaning the polished semiconductor substrate, an auxiliary pad brush including a plurality of bristles attached to an auxiliary pad brush, a support for cleaning the cleaning surface of the auxiliary pad, and an auxiliary pad brush arm operatively coupled to the auxiliary pad brush support for transferring the auxiliary pad brush to and from the cleaning pad.

According to an alternate aspect of the present invention, a method can include the steps of polishing surface of a semiconductor substrate by rotating the semiconductor substrate in contact with the surface of a polishing pad, and brushing a surface of the polishing pad with a polishing pad brush thereby removing particles from the surface of the polishing pad. Moreover, the polishing step can include providing a slurry of polishing particles on the polishing pad.

The methods and systems of the present invention thus increase the efficiency of the substrate polishing by removing particles from the polishing pad. In particular, these particles are removed by brushing the pad.

DETAILED DESCRIPTION

Figure 1:
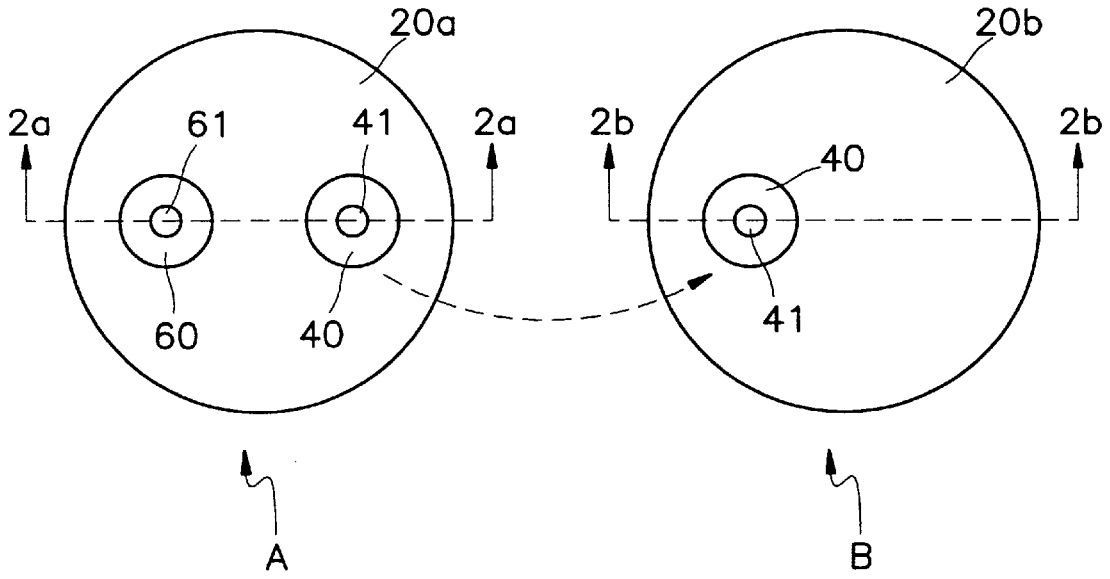
FIG. 1 (PRIOR ART)
FIG. 1 is a plan view of a chemical-mechanical polishing (CMP) system according to the prior art.
Figure 2A:
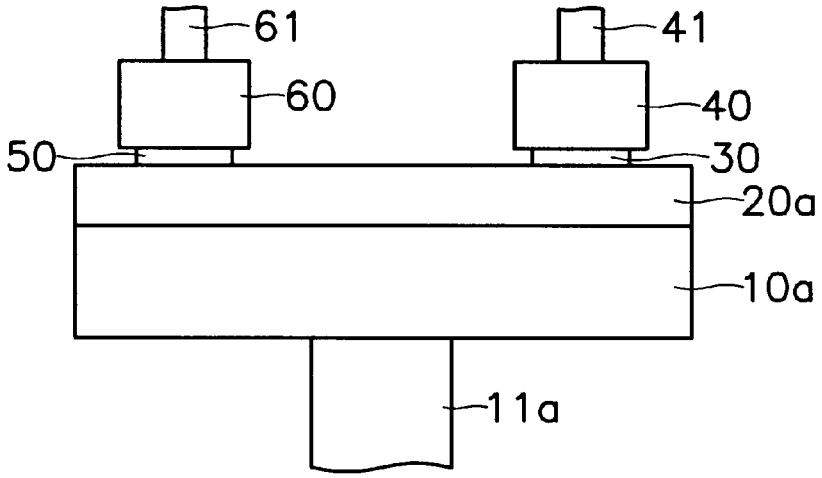
FIG. 2A (PRIOR ART)
FIG. 2A is a cross-sectional view taken along section line 2*a*—2*a* of FIG. 1.
Figure 2B:
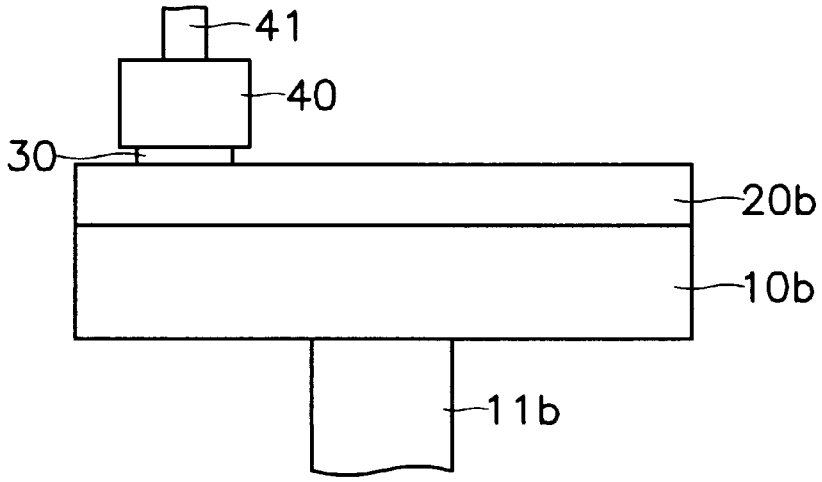
FIG. 2B (PRIOR ART)
FIG. 2B is a cross-sectional view taken along section line 2*b*—2*b* of FIG. 1.

The present invention will now be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

A chemical-mechanical polishing system according to the present invention will now be discussed with reference to FIGS. 3 and 4A-4B. This system includes a polishing portion C for polishing the surface of a semiconductor substrate, and a cleaning portion D for cleaning the surface of the semiconductor substrate.

The polishing portion C includes a first platen 110*a* having a flat end portion, a first platen rotating shaft 111*a* for rotating the first platen 110*a*. A conditioner 150 is provided for cutting back the surface of the polishing pad 120*a* to expose a new surface of the polishing pad 120*a*, a conditioning head 160 having an end portion fixed to the conditioner 150, and a conditioning head arm 161 for transferring the conditioning head 160. The clamp 140 has an end portion for fixing the semiconductor substrate 130 thereto, and a clamp arm 141 is provided for transferring the clamp 140. In addition, a polishing pad brush 170 is provided for cleaning the polishing pad 120*a*, and a polishing pad brush arm 171 is provided for transferring the polishing pad brush 170.

In particular, the conditioner 150 can be a strip of metal having diamond particles on a surface thereof which can make tight contact with the polishing pad 120*a*. Alternately, a brush can be used as the conditioner 150 to reduce damage to the surface of the polishing pad 120*a* depending on the composition of the polishing pad. When using a brush as the conditioner, the brush preferably has thick and stiff bristles to provide adequate conditioning of the polishing pad 120*a*.

Fine grooves can be formed on the surface of the polishing pad 120*a* so that a slurry can be provided to the center of the semiconductor substrate 130 even when tight contact is made between the surface of the polishing pad 120*a* and the surface of the semiconductor substrate 130.

The polishing pad brush includes bristles 173 formed from an elastic synthesized resin wherein each of the bristles has a diameter in the range of 10 $\mu$m to 2,000 $\mu$m. Each of the bristles 173 is attached at one end thereof to the support 175, and the support is connected to the polishing pad brush arm 170. In particular, the bristles can be attached to the support by inserting each of the bristles into the support. Preferably, the diameter of each bristle 173 decreases from the end portion inserted into the support 175 to the other end portion which makes contact with the polishing pad 120*a*. For example, each bristle 173 can have a cone shape thereby facilitating the removal of particles remaining in the grooves on the polishing pad 120*a*.

The cleaning portion D includes a second platen 110*b* having a flat end portion, a second platen rotating shaft 111*b* for rotating the second platen 110*b*, and an auxiliary pad 120*b* on the second platen 110*b*. As shown, the clamp 140 has an end portion to which the semiconductor substrate 130 can be fixed, and the clamp arm 141 on the substrate 130 can be transferred from the polishing portion C to the cleaning portion D. The auxiliary pad brush 180 is provided for cleaning the auxiliary pad 120*b*, and the auxiliary pad brush arm 181 is provided for transferring the auxiliary pad brush 180. The auxiliary pad brush 180 and the auxiliary pad brush arm 181 can thus be transferred to and from the cleaning portion D.

The auxiliary pad brush 180 includes bristles 183 formed from an elastic synthesized resin wherein each of the bristles has a diameter in the range of 10 μm to 2,000 μm. Each of the bristles 183 is attached at one end thereof to the support 185, and the support 185 is connected to the polishing pad brush arm 181. In particular, each of the bristles can be connected to the support by inserting one end of each of the bristles into the support. Preferably, the diameter of each bristle 183 decreases from the end inserted into the support 175 to the end which makes contact with the polishing pad 120*b*.

Figure 3:
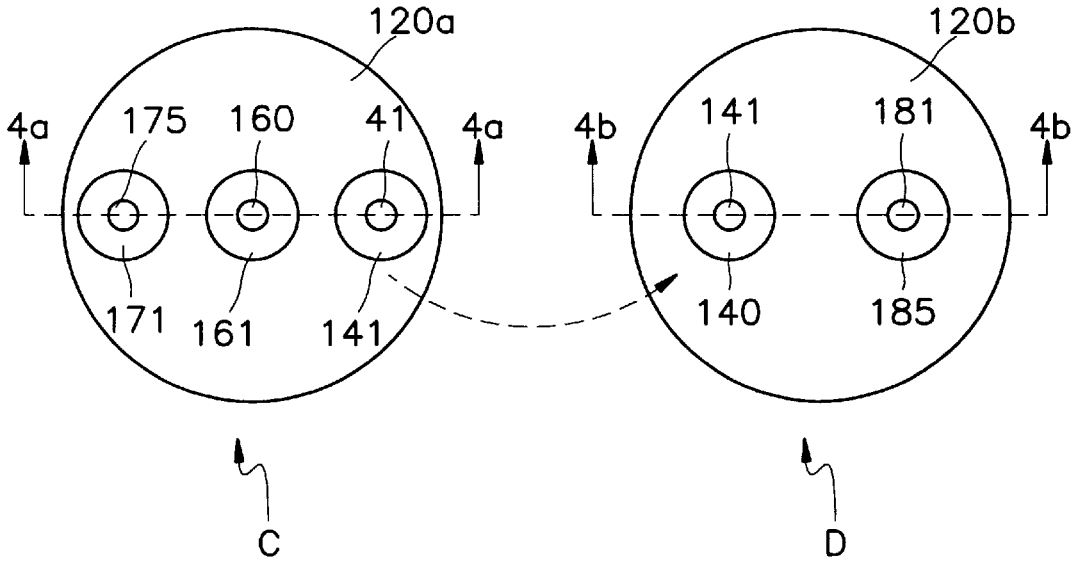
FIG. 3 is a plan view of a chemical-mechanical polishing (CMP) system according to the present invention.
Figure 4A:
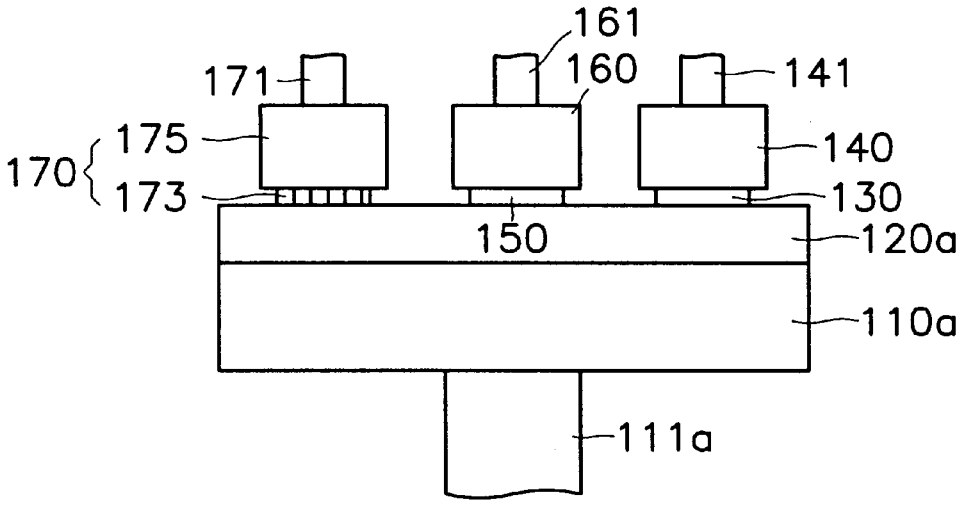
FIG. 4A is a cross-sectional view taken along section line 4*a*—4*a* of FIG. 3.
Figure 4B:
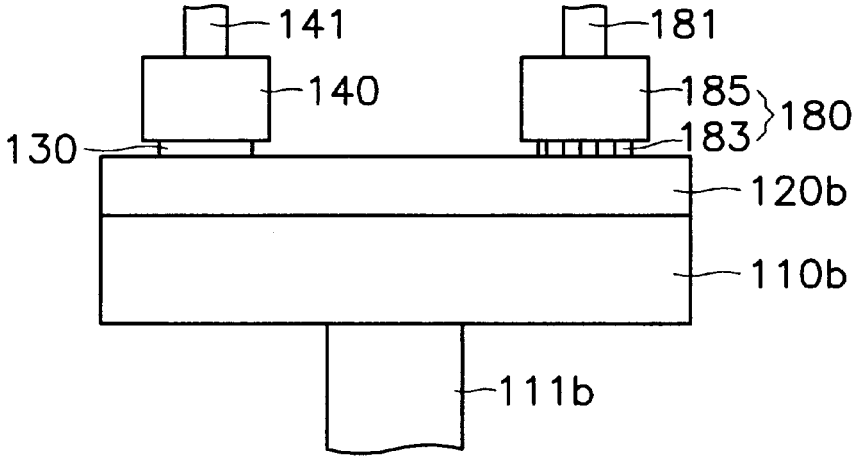
FIG. 4B is a cross-sectional view taken along section line 4*b*—4*b* of FIG. 3.
Figure 5:
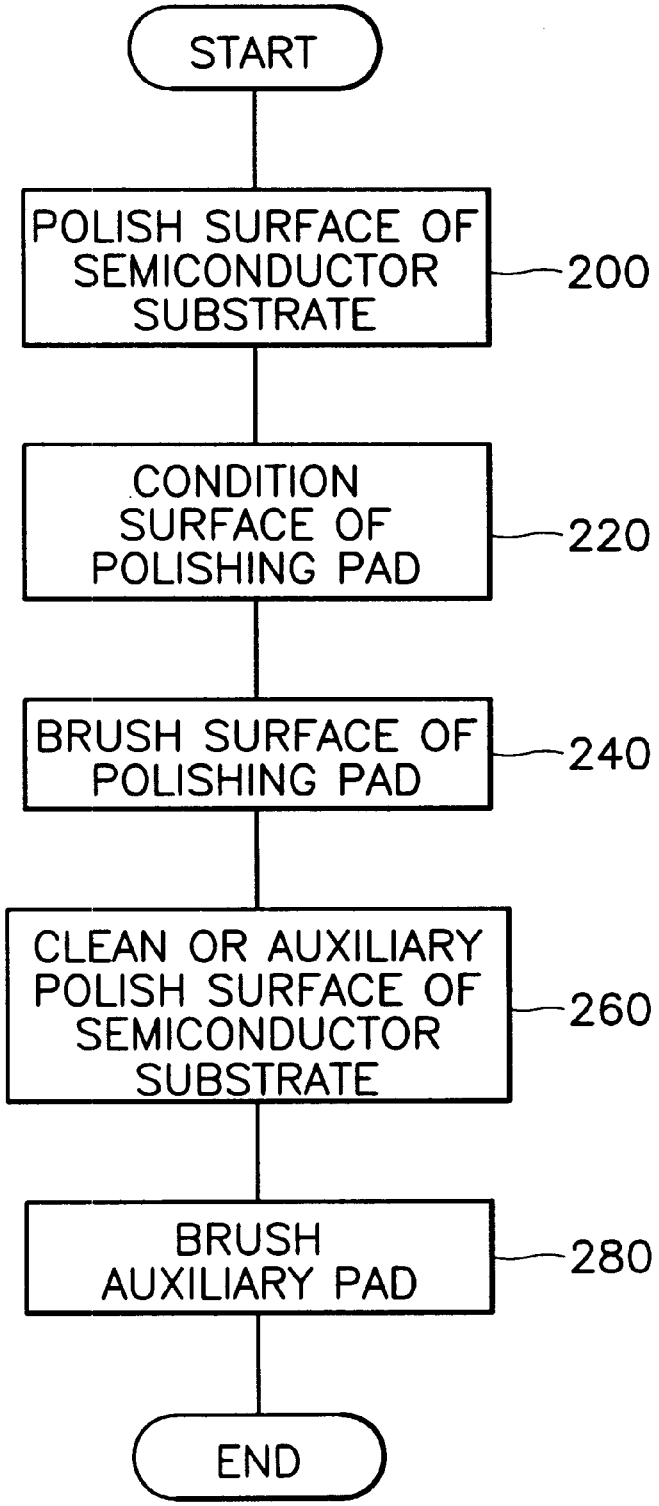
FIG. 5 is a flow chart including steps of a method for performing a chemical-mechanical polishing (CMP) operation according to the present invention.

FIG. 5 is flow chart outlining steps of a chemical-mechanical polishing method using the system illustrated in FIGS. 3, 4A and 4B. In step 200, the surface of the semiconductor substrate 130 is polished by rotating the surface of the semiconductor substrate 130 while maintaining the surface of the semiconductor substrate in tight contact with the polishing pad 120*a*. In addition, a slurry is deposited onto the polishing pad 120*a* while rotating the semiconductor substrate 130. In addition, the platen 110*a* can be simultaneously rotated thereby increasing the polishing efficiency.

The slurry can be a mixture of particles, such as alumina or silica particles, deionized water, and a chemical to provide chemical polishing. The particles contribute to the mechanical polishing while the chemical contributes to the chemical polishing. In addition, KOH or NaOH can be added to the mixture to control the ph-level.

The semiconductor substrate 130 can then be removed from the polishing pad 120*a*. In step 220, the surface of the polishing pad 120*a* is cut back to expose a new surface thereof by rotating the conditioner 150 while maintaining the conditioner 150 in tight contact with the polishing pad 120*a*. Alternately, the conditioning step 220 can be performed simultaneously with the step of polishing the semiconductor substrate 130.

As previously discussed, the conditioning step is performed primarily to cut back the surface of the polishing pad 120*a*. It may be difficult, however, to remove polishing particle lumps formed by agglutination of particles generated during the polishing step. It may also be difficult to remove polishing particles from the polishing slurry. In particular, it may be extremely difficult to remove polishing particle lumps which may become jammed in grooves formed on the surface of the polishing pad 120*a*. Even if a brush is used as the conditioner 150, the same results may be obtained because the bristles of a brush used as a conditioner will be thick and stiff.

Accordingly, the surface of the polishing pad 120*a* is brushed with polishing pad brush 170 as shown in step 240. This brushing step removes particles and polishing particle lumps remaining on the polishing pad 120*a* after the conditioning step. The brushing step may be performed after the conditioning step. Alternately, the brushing step may be performed simultaneously with the conditioning step.

The brushing step is performed while maintaining the polishing pad brush 170 in tight contact with the polishing pad 120*a*. Preferably, the polishing pad brush 170 is transferred from the center of the polishing pad 120*a* to an edge thereof while maintaining tight contact between the polishing pad brush and polishing pad. The polishing pad brush 170 is preferably detached from the polishing pad 120*a* when the polishing pad brush is transferred from the edge of the polishing pad 120*a* to the center thereof. By performing the brushing step while moving the brush from the center to the edge of the polishing pad, the brushing efficiency can be increased. The brushing efficiency can be further increased by performing the brushing step while applying a cleaning solution onto the surface of the polishing pad 120*a*. The brushing efficiency can also be increased by rotating the polishing pad brush during the brushing operation. The brushing step reduces scratching and roughening of semiconductor substrates 130 polished on the polishing pad which has been brushed.

The polished semiconductor substrate 130 is then transferred from the polishing portion C to the cleaning portion D. The polished surface of the semiconductor substrate 130 is then cleaned by rotating the semiconductor substrate 130 while maintaining tight contact between the semiconductor substrate and the auxiliary pad 120*b* as shown in step 260. In addition, a cleaning solution can be deposited on the surface of the auxiliary pad 120*b* during the cleaning step. The platen 110*b* can also be simultaneously rotated to increase cleaning efficiency.

Particle lumps and polishing particles stuck to the surface of the semiconductor substrate 130 during the polishing step may be transferred to the auxiliary pad 120*b*. Scratches may thus be produced on the surface of the semiconductor substrate 130. Accordingly, auxiliary polishing may be performed in the cleaning portion D to remove scratches produced on the surface of the semiconductor substrate 130 to reduce surface roughness thereof. The auxiliary polishing may also be referred to as slurry buffing or touch up. The auxiliary polishing can be performed by supplying a slurry including polishing particles instead of the cleaning solution to the auxiliary pad 120*b*. Even though auxiliary polishing is performed, scratches may be generated on the surface of the semiconductor substrate 130. Accordingly, polishing particles and particle lumps remaining on the cleaning pad 120*b* are preferably removed by brushing the auxiliary pad 120*b* with the auxiliary pad brush 180 after the cleaning or auxiliary polishing steps. The cleaning efficiency can be increased by rotating the auxiliary pad brush 180. In addition, the second platen 110*b* and the auxiliary pad brush 180 can be rotated simultaneously. Furthermore, it is preferable to perform a brushing while a cleaning solution is deposited onto the auxiliary pad 120*b*.

As discussed above, the scratching and roughness of a semiconductor substrate 130 can be reduced by efficiently removing particles and polishing particle lumps from the polishing pad 120*a* and the auxiliary pad 120*b* with a brush.

In the drawings and specification, there have been disclosed typical preferred embodiments of the invention and, although specific terms are employed, they are used in a generic and descriptive sense only and not for purposes of limitation, the scope of the invention being set forth in the following claims.

That which is claimed is:

1. A Chemical-Mechanical Polishing (CMP) system for a semiconductor substrate, said system comprising:

a polishing pad having a polishing surface for polishing the semiconductor substrate;

a polishing pad brush including a plurality of bristles attached to a support for cleaning said polishing surface of said polishing pad;

a polishing pad brush arm operatively coupled to said brush support for transferring said polishing pad brush to and from said polishing pad;

a conditioner for conditioning said polishing surface of said polishing pad; and a conditioner arm operatively coupled to said conditioner for transferring said conditioner to and from the polishing pad.

2. A Chemical-Mechanical Polishing (CMP) system according to claim 1 wherein each of said bristles comprises a synthetic resin.

3. A Chemical-Mechanical Polishing (CMP) system according to claim 1 wherein each of said bristles has a diameter in the range of 10 $\mu$m to 2000 $\mu$m.

4. A Chemical-Mechanical Polishing (CMP) system according to claim 1 wherein said polishing pad brush arm transfers said polishing pad brush from a center portion of said polishing pad to an edge portion of said polishing pad.

5. A Chemical-Mechanical Polishing (CMP) system for a semiconductor substrate, said system comprising:

a polishing station for polishing the semiconductor substrate wherein said polishing station includes, a polishing pad having a polishing surface for polishing the semiconductor substrate, a conditioner for conditioning said polishing surface of said polishing pad, and a conditioner arm operatively coupled to said conditioner for transferring said conditioner to and from the polishing pad; and a cleaning station for cleaning the polished semiconductor substrate wherein said cleaning station includes, an auxiliary pad having a cleaning surface for cleaning the polished semiconductor substrate, an auxiliary pad brush including a plurality of bristles attached to an auxiliary pad brush support for cleaning said cleaning surface of said auxiliary pad, and an auxiliary pad brush arm operatively coupled to said auxiliary pad brush support for transferring said auxiliary pad brush to and from said cleaning pad.

6. A Chemical-Mechanical Polishing (CMP) system according to claim 5 wherein said polishing station further includes, a polishing pad brush including a plurality of bristles attached to a support for cleaning said polishing surface of said polishing pad, and a polishing pad brush arm operatively coupled to said brush support for transferring said polishing pad brush to and from said polishing pad.

7. A Chemical-Mechanical Polishing (CMP) system according to claim 5 wherein each of said bristles comprises a synthetic resin.

8. A Chemical-Mechanical Polishing (CMP) system according to claims 7 wherein said synthetic resin comprises nylon.

9. A Chemical-Mechanical Polishing (CMP) system according to claim 5 wherein each of said bristles has a diameter in the range of 10 $\mu$m to 2000 $\mu$m.

10. A Chemical-Mechanical Polishing (CMP) system according to claim 5 wherein each of said bristles has a diameter that decreases from a first end adjacent said brush support to a second end opposite said brush support.

11. A Chemical-Mechanical Polishing (CMP) system according to claim 5 wherein said auxiliary pad brush arm transfers said auxiliary pad brush from a center portion of said auxiliary pad to an edge portion of said auxiliary pad.

12. A Chemical-Mechanical Polishing (CMP) method for cleaning a polishing pad used to polish a surface of a semiconductor substrate by rotating the semiconductor substrate in contact with a surface of a polishing pad, said method comprising the step of:

brushing said surface of said polishing pad with a polishing pad brush thereby removing particles from said surface of said polishing pad, wherein said brushing step further comprises the steps of, maintaining said polishing pad brush in contact with said polishing pad while transferring said polishing pad brush from a center portion of said polishing pad to an edge thereof, after maintaining said polishing pad brush in contact with said polishing pad while transfering said polishing pad brush from said center portion to said edge, removing said polishing pad brush from said surface of said polishing pad, and after removing said polishing pad brush from said surface, transferring said polishing pad brush to said center portion of said surface of said substrate while maintaining a spacing between said polishing pad brush and said surface of said polishing pad.

13. A method according to claim 12 wherein said brushing step comprises rotating said polishing pad brush.

14. A method according to claim 12 wherein said brushing step further comprises rotating said polishing pad while simultaneously rotating said polishing pad brush.

15. A method according to claim 12 wherein said brushing step further comprises spraying a cleaning solution onto said surface of said polishing pad.

16. A Chemical-Mechanical Polishing (CMP) method for polishing a semiconductor substrate, said method comprising the steps of:

polishing a surface of the semiconductor substrate by rotating the semiconductor substrate in contact with a surface of a polishing pad;

cleaning the surface of the semiconductor substrate by rotating the semiconductor substrate in contact with an auxiliary pad; and brushing said auxiliary pad thereby removing particles therefrom.

17. A method according to claim 16 wherein said polishing step further comprises providing a slurry of polishing particles on said polishing pad.

18. A method according to claim 16 wherein said cleaning step further comprises spraying a cleaning solution onto said auxiliary pad.

19. A method according to claim 16 wherein said cleaning and brushing steps are performed simultaneously.

* * * * *